US009438980B2

(12) United States Patent
Huang et al.

(10) Patent No.: US 9,438,980 B2
(45) **Date of Patent: *Sep. 6, 2016**

(54) HEADPHONE EAR CUP

(71) Applicant: MERRY ELECTRONICS (SHENZHEN) CO., LTD., Shenzhen (CN)

(72) Inventors: Chung-Yi Huang, Taichung (TW); Chih-Feng Chao, Taichung (TW); Yu-Jen Cho, Taichung (TW)

(73) Assignee: MERRY ELECTRONICS (SHENZHEN) CO., LTD. (CN)

( * ) Notice: Subject to any disclaimer, the term of this patent is extended or adjusted under 35 U.S.C. 154(b) by 0 days.

This patent is subject to a terminal disclaimer.

(21) Appl. No.: 14/548,744

(22) Filed: Nov. 20, 2014

(65) Prior Publication Data

US 2016/0150307 A1 May 26, 2016

(51) Int. Cl.
*H04R 25/00* (2006.01)
*H04R 1/10* (2006.01)
*H04R 5/033* (2006.01)

(52) U.S. Cl.
CPC ..... *H04R 1/10* (2013.01); *H04R 1/1008* (2013.01); *H04R 1/1083* (2013.01); *H04R 5/033* (2013.01); *H04R 2201/105* (2013.01); *H04R 2460/15* (2013.01)

(58) Field of Classification Search
CPC H04R 1/1008; H04R 1/1058; H04R 1/1075; H04R 1/1083; H04R 1/1091; H04R 5/033; H04R 5/0335; H04R 2201/105; H04R 2201/107; H04R 2460/15; H04R 11/14
USPC ..... 381/309, 71.6, 370, 371, 372, 374, 376; 181/128, 129; 2/209, 909, 906; 128/864, 867
See application file for complete search history.

(56) References Cited

U.S. PATENT DOCUMENTS 5,970,160 A * 10/1999 Nilsson ..... H04R 1/1083 181/129
8,467,539 B2 * 6/2013 Sapiejewski ..... H04R 1/1008 381/371
2009/0110226 A1 * 4/2009 Ishida ..... H04R 1/1008 381/370

* cited by examiner

*Primary Examiner* — Huyen D Le
(74) *Attorney, Agent, or Firm* — Bacon & Thomas, PLLC

(57) ABSTRACT

A headphone ear cup for mounting on a surface of a speaker unit of a headphone includes an annular cushion having a sound hole at a center thereof, and a composite cover having a ventilative layer and an air-tight layer. The composite cover wraps around the annular cushion and defines an inner-side portion, an outer-side portion and an ear-abutting portion. The ventilative and air-tight layers are respectively formed by the outer-side portion and a composite of the inner-side and ear-abutting portions or by a composite of the outer-side and ear-abutting portions and the inner-side portion. Therefore, the ventilative layer and the annular cushion form a good heat dissipation path to have excellent air-permeable property, and air-tight layer provides an improved acoustic field effect.

14 Claims, 3 Drawing Sheets

HEADPHONE EAR CUP

BACKGROUND OF THE INVENTION

1. Field of the Invention

The present disclosure relates to a headphone ear cup and more particularly, to a headphone ear cup having a composite cover which includes different regions with different air permeability, such that the headphone ear cup of the present disclosure can have excellent air-permeable property and improved acoustic field effect.

2. Description of the Related Art

A traditional headphone ear cup is substantially annular in shape and connected with a surface of a speaker unit of a headphone, and usually comprises an annular cushion and a cover covering the annular cushion.

Most of the existing covers of the traditional headphone ear cup are made of a single material. Specifically, in order to isolate the ambient sound as far as possible to enable a user to clearly hear the sound from the speaker unit through the sound hole of the headphone ear cup, i.e. to establish a satisfied acoustic field, the cover of the traditional headphone ear cup is made of a single material with high isolation but low air permeability, thereby sacrificing the air-permeable property of the cover. As such, the user may feel uncomfortable after using the traditional headphone ear cup with air-tight cover for a long time.

SUMMARY OF THE INVENTION

In light of the above, the primary objective of the present disclosure is to provide a headphone ear cup having excellent air-permeable property and improved acoustic field effect.

To attain the above objective, the present disclosure provides a headphone ear cup for disposing on a surface of a speaker unit of a headphone, which includes an annular cushion and a composite cover. The annular cushion is provided with a sound hole at the center thereof and is wrapped by the composite cover. The composite cover comprises a ventilative layer and an air-tight layer, and defines an inner-side portion surrounding the sound hole, an outer-side portion opposite to the inner-side portion spacedly and remote from the sound hole, and an ear-abutting portion connected between the inner-side and the outer-side portions. The ventilative layer has an air permeability higher than that of the air-tight layer. The ventilative layer is formed by the outer-side portion, or by the outer-side portion and the ear-abutting portion.

Because the ventilative layer of the composite cover and the annular cushion form a heat dissipation path, and the air-tight layer of the composite cover provides a better sound insulation effect, the headphone ear cup of the present disclosure can have excellent air-permeable property thus providing comfortable feeling to a user and can improve the acoustic filed effect.

DETAILED DESCRIPTION OF EMBODIMENTS

Figure 1:
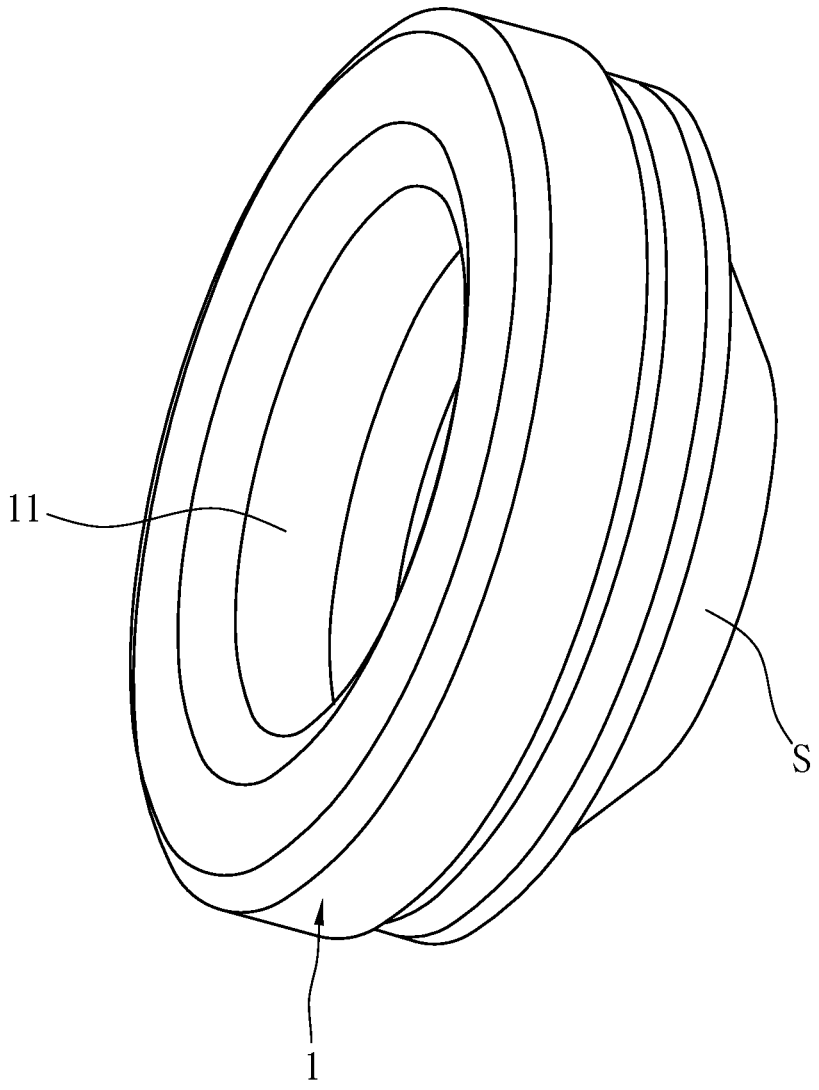
FIG. 1 is a perspective view of a headphone mounted with a headphone ear cup according to a first embodiment of the present disclosure.

Reference will now be made in detail to the exemplary embodiments of the present disclosure, examples of which are illustrated in the accompanying drawings. Wherever possible, the same reference numeral represents the same or similar parts.

Figure 2:
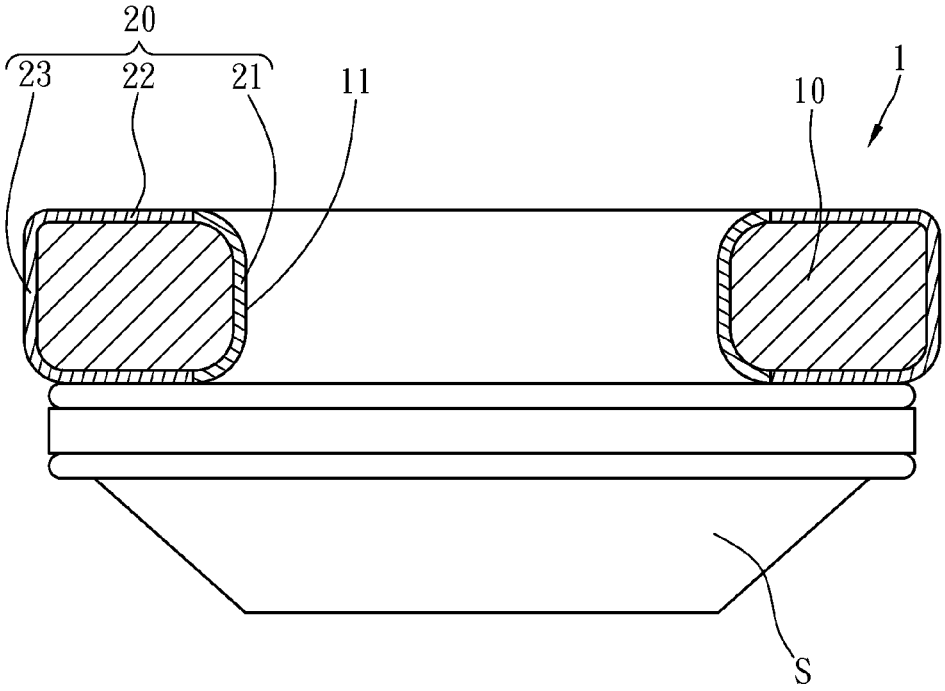
FIG. 2 is a partial cross-sectional view of FIG. 1, showing the structure of the headphone ear cup of the first embodiment.

Referring to FIG. 1 and FIG. 2, a headphone is taken as an example in the following description. A headphone ear cup 1 of a first embodiment mainly includes an annular cushion 10 and a composite cover 20. The structures of these components and relationship therebetween are described in detail as follows.

The annular cushion 10 is substantially shaped as a circular ring and made of an inert foam material. The annular cushion 10 is disposed on a surface of a speaker unit S of a headphone. The annular cushion 10 has a sound hole 11 provided at the center thereof for passing of the sound outputted from the speaker unit S.

The composite cover 20 is formed by sewing two different fabrics includes a ventilative layer and an air-tight layer, and used to wrap around the surface of the annular cushion 10. The composite cover 20 can be divided into at least an inner-side portion 21, an ear-abutting portion 22 and an outer-side portion 23. The inner-side portion 21 surrounds around the whole of the sound hole 11, and the outer-side portion 23 is opposite to the inner-side portion 21 spacedly and remote away from the sound hole 11. The inner-side portion 21 is made of the fabrics having relatively low air permeability but high sound insulation effect, such as spun protein PU fabrics, such that the ambient sound can be effectively insulated and the sound from the speaker unit S can be clearly heard by a user, thereby improving the acoustic field effect so as to have good sound quality.

The ear-abutting portion 22 is annular in shape and connected between the inner-side portion 21 and the outer-side portion 23. In addition, the ear-abutting portion 22 is disposed in a way that the back of the ear-abutting portion is spaced away from the speaker unit S. Because the ear-abutting portion 22 is used to contact with the skin of a user, it is preferably made of the fabrics with relatively high air permeability so as to improving the air-permeable property of the headphone ear cup. In this embodiment, the ear-abutting portion 22 and the outer-side portion 23 are made of the same material and combinedly form the ventilative layer, whereas the inner-side portion 21 serves as the air-tight layer. Therefore, the ear-abutting portion 22, a part of the annular cushion 10 and the outer-side portion 23 can form a better heat dissipation path so as to provide comfortable feeling to the user wearing the headphone provided with the headphone ear cup of the present disclosure.

Because the air permeability of the outer-side portion 23 is higher than that of the inner-side portion 21, the headphone ear cup 1 can improve the acoustic filed effect through the inner-side portion 21 having lower air permeability but higher sound insulation effect, and provide better heat dissipation effect through the heat dissipation path formed by the ear-abutting portion 22 and the outer-side portion 23, which have higher air permeability, and the annular cushion 10. Accordingly, the headphone ear cup of the present disclosure possesses superior heat dissipation effect and excellent sound quality due to improved acoustic field effect in comparison with the prior headphone ear cup.

It is to be noted that the shape of the ear-abutting portion 22 and the outer-side portion 23 are not limited to the annular shape, and the ear-abutting portion 22 and the outer-side portion 23 can be made of any suitable material as long as they are able to form a satisfied heat dissipation path.

Figure 3:
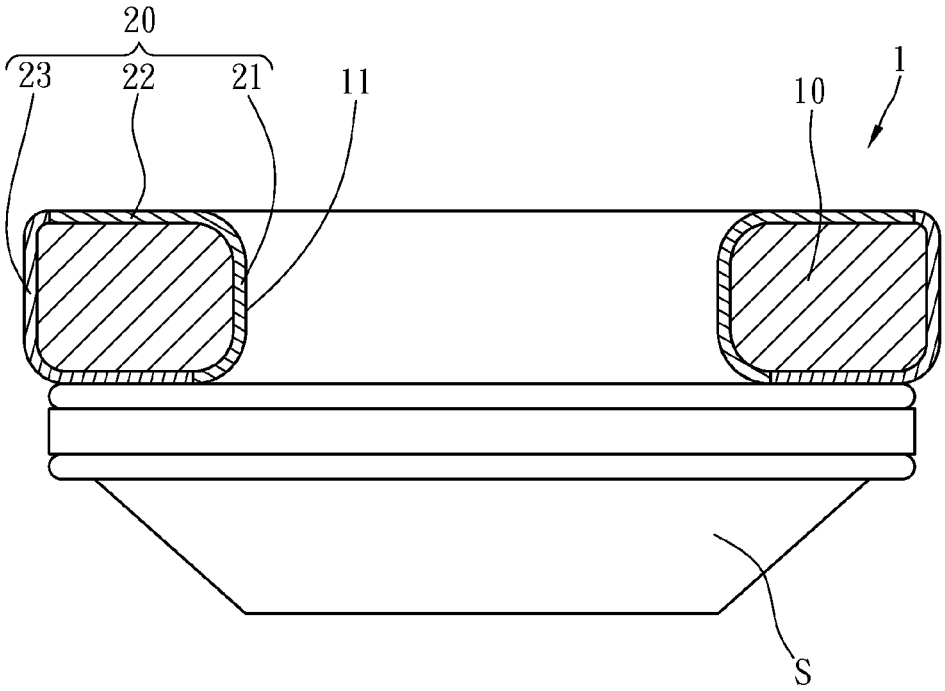
FIG. 3 is a partial cross-sectional view, showing the structure of a headphone ear cup according to a second embodiment of the present disclosure.

The present disclosure further provides a second embodiment as shown in FIG. 3. The headphone ear cup of the second embodiment is substantially the same as that of the first embodiment, except that the ear-abutting portion 22 and the inner-side portion 21 are integrally made of the same material to form the air-tight layer, and the ventilative layer is formed by the outer-side portion 23. As such, the annular cushion 10 and the outer-side portion 23 having higher air permeability can form a better heat dissipation path, and provide the heat dissipation effect and the sound quality of the headphone ear cup of the present disclosure can be improved accordingly.

Figure 4:
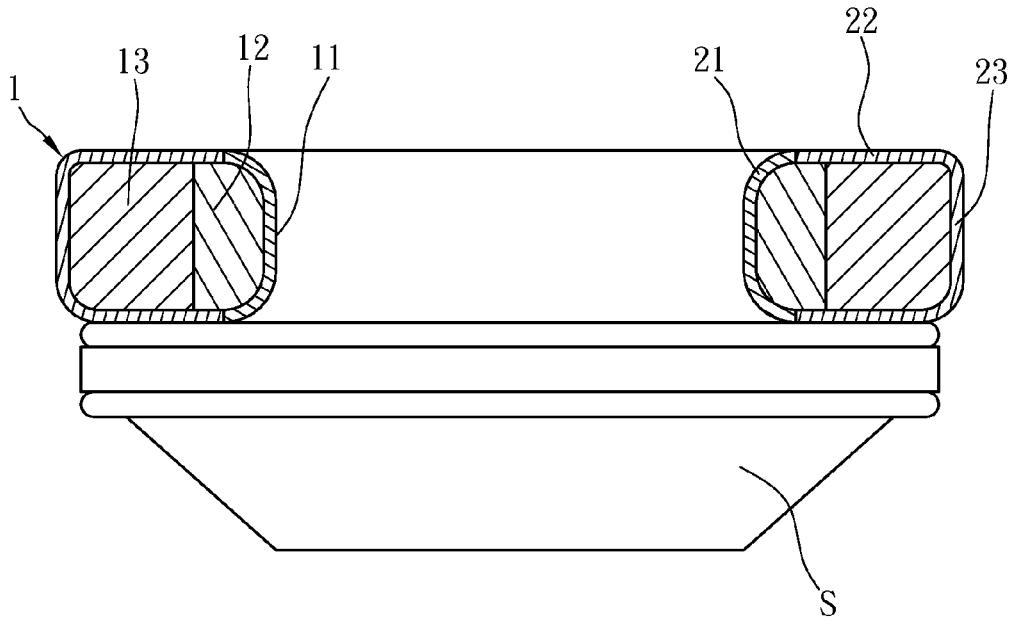
FIG. 4 is a partial cross-sectional view, showing the structure of a headphone ear cup according to a third embodiment of the present disclosure.

In order to further enhance the heat dissipation effect of the present disclosure, a third embodiment is disclosed in FIG. 4. The headphone ear cup of the third embodiment is substantially the same as that of the first embodiment, except that the annular cushion 10 comprises an annular body 12 and an air-permeable portion 13 disposed at the outer periphery of the annular body 12. The annular body 12 is made of a foam material having relatively high density and relatively small pore size, whereas the air-permeable portion 13 is made of a foam material having relatively low density and relatively large pore size. The annular body 12 is disposed around the sound hole 11 and adjacent to the air-tight layer, and the air-permeable portion 13 is disposed adjacent to the ventilative layer.

Because the annular body 12 is made of the foam material having relatively high density, the sound outputted from the speaker unit S cannot easily penetrate the annular body 12 and the ambient sound can be effectively insulated, such that the sound insulation effect and the sound quality can be improved so as to establish a good acoustic field effect. Moreover, the heat dissipation effect of the headphone ear cup 1 can be further enhanced since the air-permeable portion 13 is abutted with the ventilative layer.

It has to be noted that the annular body 12 is not limited to be disposed adjacent to the inner-side portion 21. For example, any suitable material may be filled between the annular body 12 and the inner-side portion 21 so as to improve the sound insulation effect. In addition, the shape of the air-permeable portion 13 is not limited to the annular shape, and the air-permeable portion 13 is not limited to be disposed around the sound hole 11 or disposed adjacent to the annular body 12. Specifically, both the shape and the location of the air-permeable portion 13 can be varied as long as a heat dissipation path can be formed through the air-permeable portion 13, the ear-abutting portion 22 and the outer-side portion 23.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A headphone ear cup, comprising:

an annular cushion provided at a center thereof with a sound hole; and a composite cover having a ventilative layer and an air-tight layer, and wrapping around the annular cushion to define an inner-side portion surrounding the sound hole, an outer-side portion opposite to the inner-side portion spacedly and remote from the sound hole, and an ear-abutting portion connected between the outer-side portion and the inner-side portion;

wherein the ventilative layer has an air permeability higher than that of the air-tight layer, the ventilative layer is formed by the outer-side portion and the ear-abutting portion, and the air-tight layer is formed by the inner-side portion;

wherein the ventilative layer and the air-tight layer are made from different material.

2. The headphone ear cup as defined in claim 1, wherein the outer-side portion and the ear-abutting portion are made of a same material.

3. The headphone ear cup as defined in claim 1, wherein the annular cushion has an annular body and at least one air-permeable portion arranged at an outer periphery of the annular body; two sides of the at least one air-permeable portion are connected to the ear-abutting portion and the outer-side portion, respectively; the at least one air-permeable portion is made of a porous material having a density lower than that of the annular body.

4. The headphone ear cup as defined in claim 3, wherein the annular body of the annular cushion is abutted with the inner-side portion.

5. The headphone ear cup as defined in claim 3, wherein the air-permeable portion of the annular cushion has an annular shape and surrounds around the sound hole.

6. The headphone ear cup as defined in claim 5, wherein the air-permeable portion of the annular cushion is abutted with the annular body.

7. A headphone ear cup for disposing on a headphone, the headphone ear cup comprising:

an annular cushion provided at a center thereof with a sound hole; and a composite cover having a ventilative layer and an air-tight layer, and wrapping around the annular cushion to define an inner-side portion surrounding the sound hole, an outer-side portion opposite to the inner-side portion spacedly and remote from the sound hole, and an ear-abutting portion connected between the outer-side portion and the inner-side portion;

wherein the ventilative layer has an air permeability higher than that of the air-tight layer, the ventilative layer is formed by the outer-side portion, and the air-tight layer is formed by the inner-side portion and the ear-abutting portion;

wherein the ventilative layer and the air-tight layer are made from different material.

8. The headphone ear cup as defined in claim 7, wherein the inner-side portion and the ear-abutting portion are made of a same material.

9. The headphone ear cup as defined in claim 7, wherein the annular cushion has an annular body and at least one air-permeable portion arranged at an outer periphery of the annular body; two sides of the at least one air-permeable portion are connected to the ear-abutting portion and the outer-side portion, respectively; the at least one air-permeable portion is made of a porous material having a density lower than that of the annular body.

10. The headphone ear cup as defined in claim 9, wherein the annular body of the annular cushion is abutted with the inner-side portion.

11. The headphone ear cup as defined in claim 9, wherein the air-permeable portion of the annular cushion has an annular shape and surrounds around the sound hole.

12. The headphone ear cup as defined in claim 11, wherein the air-permeable portion of the annular cushion is abutted with the annular body.

13. A headphone ear cup, comprising:

an annular cushion provided at a center thereof with a sound hole; and a composite cover having a ventilative layer and an air-tight layer, and wrapping around the annular cushion to define an inner-side portion surrounding the sound hole, an outer-side portion opposite to the inner-side portion spacedly and remote from the sound hole, and an ear-abutting portion connected between the outer-side portion and the inner-side portion;

wherein the ventilative layer has an air permeability higher than that of the air-tight layer, the ventilative layer is formed by the outer-side portion and the ear-abutting portion, and the air-tight layer is formed by the inner-side portion; and wherein the annular cushion has an annular body and at least one air-permeable portion arranged at an outer periphery of the annular body; two sides of the at least one air-permeable portion are connected to the ear-abutting portion and the outer-side portion, respectively; the at least one air-permeable portion is made of a porous material having a density lower than that of the annular body.

14. A headphone ear cup for disposing on a headphone, the headphone ear cup comprising:

an annular cushion provided at a center thereof with a sound hole; and a composite cover having a ventilative layer and an air-tight layer, and wrapping around the annular cushion to define an inner-side portion surrounding the sound hole, an outer-side portion opposite to the inner-side portion spacedly and remote from the sound hole, and an ear-abutting portion connected between the outer-side portion and the inner-side portion;

wherein the ventilative layer has an air permeability higher than that of the air-tight layer, the ventilative layer is formed by the outer-side portion, and the air-tight layer is formed by the inner-side portion and the ear-abutting portion, and wherein the annular cushion has an annular body and at least one air-permeable portion arranged at an outer periphery of the annular body; two sides of the at least one air-permeable portion are connected to the ear-abutting portion and the outer-side portion, respectively; the at least one air-permeable portion is made of a porous material having a density lower than that of the annular body.

* * * * *